United States Patent [19]

Sandler

[11] 4,271,552

[45] Jun. 9, 1981

[54] TORPEDO FLOATATION DEVICE

[75] Inventor: Charles S. Sandler, Silver Spring, Md.

[73] Assignee: Presearch Incorporated, Arlington, Va.

[21] Appl. No.: 55,401

[22] Filed: Jul. 6, 1979

[51] Int. Cl.[3] ..... B63B 21/52; B63B 51/02

[52] U.S. Cl. ..... 9/9; 114/20 R; 114/54; 152/397

[58] Field of Search ..... 152/397; 9/9; 114/20 R, 114/54, 267, 219, 220

[56] References Cited

U.S. PATENT DOCUMENTS

| | | | |
|---|---|---|---|
| 1,998,805 | 4/1935 | Driggs | 114/20 R |
| 3,175,525 | 3/1965 | DeVries | 9/9 |
| 3,237,675 | 3/1966 | Fisher | 152/397 |
| 3,608,510 | 9/1971 | DeVries | 114/54 |
| 3,648,312 | 3/1972 | May | 9/9 |
| 3,706,294 | 12/1972 | Radford | 114/54 |

*Primary Examiner*—Trygve M. Blix
*Assistant Examiner*—D. W. Keen
*Attorney, Agent, or Firm*—Cushman, Darby & Cushman

[57] ABSTRACT

A torpedo recovery system including an expandable sleeve surrounding a portion of the torpedo. Upon activation of the recovery system gas is introduced into the sleeve, causing it to expand. The sleeve is clamped firmly at two distinct longitudinal positions along the torpedo and is releasably clamped at a third longitudinal position. When the differential pressure between gas inside of the sleeve and water outside the sleeve reaches a predetermined threshold level, the releasable clamp releases the sleeve allowing it to gradually expand to form a doughnut-shaped floatation collar. The expanding sleeve provides gradually increasing drag to slow the torpedo and then positive buoyancy for lifting it to the water's surface.

8 Claims, 11 Drawing Figures

TORPEDO FLOATATION DEVICE

BACKGROUND OF THE INVENTION

This invention relates generally to the recovery of torpedoes and other objects from beneath the surface of water and more specifically to inflatable bags which produce positive buoyancy for bringing a torpedo to the water's surface.

Torpedo design and development efforts, particularly those directed to the more advanced torpedoes, require that prototype designs be "exercisable". Exercisability implies that the torpedo be capable of being configured in a nonexplosive version exhibiting the same physical characteristics and dynamic performance parameters as its warshot counterpart, so that it may be carried, launched, and run at sea against targets in the same manner as a warshot version would be. An exercise torpedo attempts to duplicate the salient characteristics of its warshot counterpart and is instrumented to record and make available data related to the dynamic performance of the torpedo and to its interaction with a target. More importantly, this data must be recoverable either by telemetry or by the physical recovery of the exercised torpedo itself. For economic reasons, recovery of the torpedo itself is generally considered preferable.

By design, all warshot torpedoes are negatively buoyant throughout their run. Unless the torpedo encounters a target, it will sink at the end of its run so that it does not become an explosive threat to friendly surface craft and cannot be retrieved by the enemy.

Current torpedo designs include larger warheads and are generally more densely packaged and include more powerful propulsion systems, causing greater negative buoyancy than that of previous torpedoes. The increased negative buoyancy and increased speed of the current torpedoes complicate recovery of the torpedo. Previously utilized recovery systems have proven inadequate for a variety of reasons.

In the past primarily three different methods have been employed for the recovery of torpedoes that have been exercised: (1) hoisting the torpedo from the floor of the body of water into which it was fired by means of hooks, lines, etc.; (2) providing positive buoyancy at the end of a run by weight dropping, and (3) providing positive buoyancy at the end of a run by increasing torpedo displacement. The third method, i.e., providing positive buoyancy at the end of a run by increasing torpedo displacement, has been successfully utilized with previous torpedo designs. All of these "displacement" systems include a balloon or bag attached to the torpedo when it is fired. A suitable gas generator within the torpedo is triggered by some event such as a change in torpedo speed, the increase of pressure beyond some threshold level, etc., and supplies gas for inflating the balloon or bag to create the desired positive buoyancy. Initiation of the gas pressurization system generally occurs upon torpedo propulsion power plant shutdown.

Various types of balloons, sleeves, collars, and other negative buoyancy configurations have been utilized in the past. However, as torpedoes have become faster and more dense, previously utilized designs have proven to be inadequate.

The most basic type of displacement system is a collapsible pontoon of the general type shown in U.S. Pat. No. 3,608,510. Pontoon systems cannot be used in the recovery of horizontally moving objects and are thusly not suitable for torpedoes.

A slightly different "balloon" system utilized for torpedoes is shown in U.S. Pat. No. 3,175,525. In such "balloon" systems a gas filled bag is ejected from the torpedo and tethered to the torpedo via a line. This type of system is effective only for relatively slow moving objects and is completely ineffective for the recovery of objects that roll. Torpedoes tend to roll while they descend and thus cannot use the "balloon"-type system.

Other displacement recovery systems utilize balloons attached to the nose end of a torpedo, such as shown by U.S. Pat. No. 1,998,805. A major drawback to this arrangement is that it is unsuitable for use with acoustic torpedoes, wherein the nose portion must remain free of obstruction to sound waves transmitted from and reflected sound waves received by the torpedo. In addition, this type of system is only useful with slow moving vehicles.

One of the more useful of the current displacement systems is the expandable collar of the type illustrated by U.S. Pat. Nos. 3,648,312 and 3,706,294. Such collars are fabricated from fabric-reinforced heavy material forming a closed bag. In order to provide a tapered shape for aiding deceleration of the torpedo being recovered, additional reinforcement fabric is provided at the forward end. A gas seal is provided only by the use of a closed bag. The use of such heavy walled, closed bags includes several disadvantages. They are complex, expensive to produce and extremely difficult to install. The use of a folded heavy bag requires a relatively deep recess in the exercise section of the torpedo not always tolerable with small torpedoes. Much of the surface area of the exercise section of the torpedo is covered by the inner wall of the bag (adjacent the outer surface of the torpedo) so that there is little room for anything else.

SHORT STATEMENT OF THE INVENTION

The present invention is directed to providing a displacement type recovery device which overcomes many of the disadvantages associated with the use of currently available systems. In particular this invention is directed to a recovery system for use with the faster and more dense torpedoes now in design and development.

The recovery system according to the present invention provides a relatively thin-walled, non-reinforced, recovery sleeve for use with more advanced, faster, and more dense torpedoes. By utilizing a thin-walled, nonreinforced design, the sleeve requires considerably less volume to store than previous designs. In addition, the use of a thin-walled design allows for more simple installation. By virtue of its simplicity, the recovery system according to the present invention can be produced at significantly reduced cost and is therefore expendable.

The recovery system provided, by virtue of its specific design and interaction with the water surrounding it, takes on a highly desirable wedge shape so as to provide decelerating drag on the torpedo being recovered. It is unnecessary to resort to nonuniform bag thickness or the use of reinforcing layers to achieve the desired shape.

The preferred recovery system is essentially a sleeve having cylindrical form and partially folded over itself. The sleeve begins to unfold at the rear, thereby gradually adding relatively unstressed rubber to that portion of the sleeve already unfolded. In this manner the bag is inflated to a relatively large displacement volume without a disproportionately high level of stress at any particular portion thereof. At the same time that the sleeve is unfolding, the surface of the exercise portion of the torpedo is exposed so that marker and tracking devices have access to the water.

The more advanced dense torpedoes have a relatively small exercise section when compared with torpedoes in current use. Because they are more negatively buoyant, large inflation volume is required to bring the torpedo to the water's surface. To achieve this increased displacement volume utilizing a heavy-walled reinforced bag, a large bag would be required and hence bag storage volume in the exercise section of the torpedo would be much too large.

The recovery system according to the present invention utilizes a sleeve rather than a completely closed bag. This feature alone allows the device to be manufactured more inexpensively and allows for easier quality control. Furthermore, the use of a thin-walled non-reinforced wall allows for easy installation and removal of the sleeve and permits a diver to easily slash the sleeve if required. This is not possible with a heavy, reinforced thick-walled device.

BRIEF DESCRIPTION OF THE DRAWINGS

Many of the attendant advantages of the present invention will be readily apparent as the invention becomes better understood by reference to the following detailed description and the appended claims, when considered in conjunction with the accompanying drawings, wherein:

DETAILED DESCRIPTION OF THE PREFERRED EMBODIMENT

Figure 1:
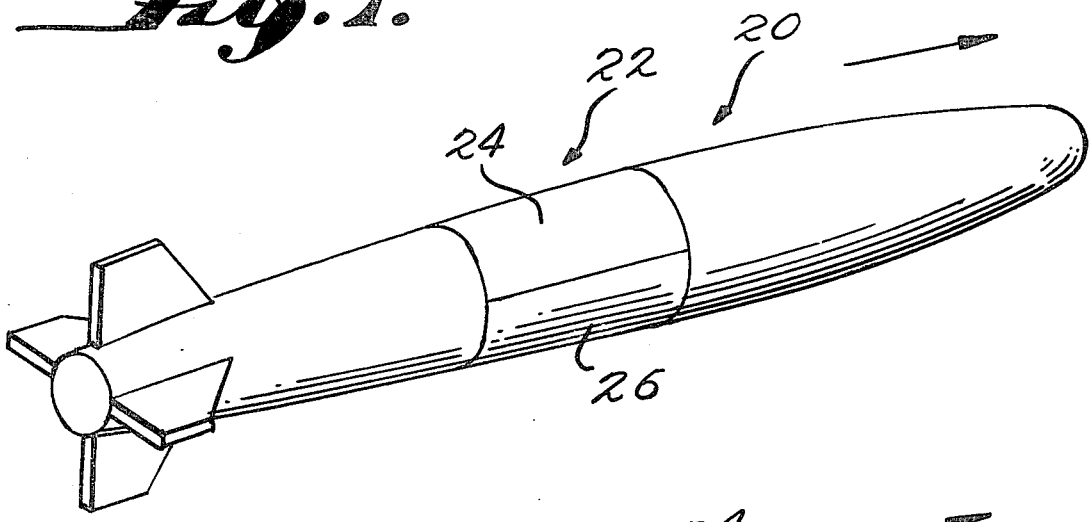
FIG. 1 is a perspective view of a torpedo showing the placement of the recovery system according to the present invention under a hard blown-away cover.

Referring now to the figures wherein like reference numerals designate like or corresponding parts throughout the several views and referring specifically to FIG. 1, there is generally shown a torpedo 20 to be recovered after being exercised. The torpedo recovery system, generally designated by reference numeral 22 is in place under a blown-away cover including a pair of semi-circular shaped blown-away cover members 24 and 26. The blow away cover does not form a part of this invention, but is so widely used with other types of recovery systems that it is shown here merely in simplified form. The semi-circular cover members 24 and 26 are detented and upon expansion of an inflatable bag thereunder are pushed away to allow the bag to continue to expand.

Figure 2:
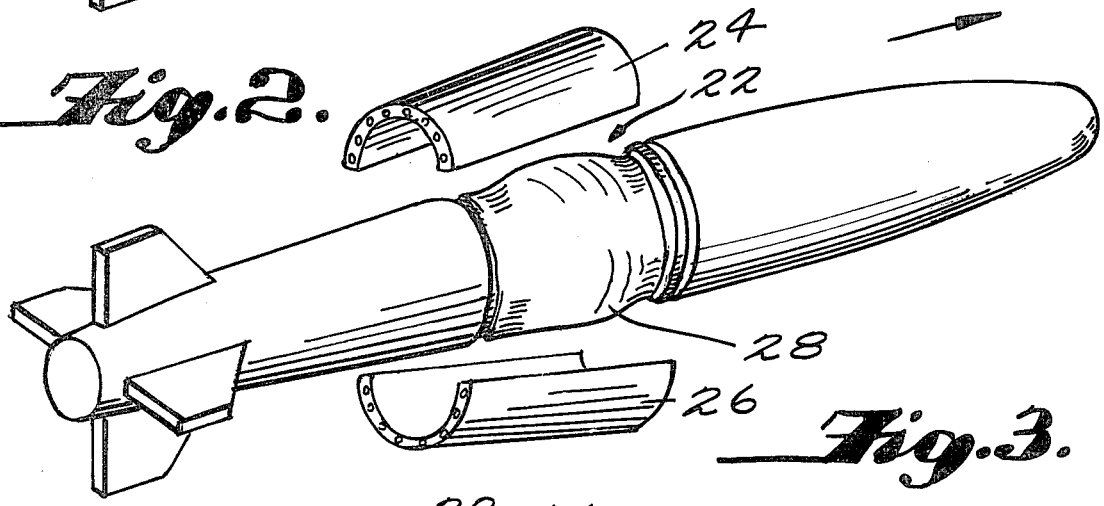
FIG. 2 is a perspective view of a torpedo employing the recovery system according to the present invention with the sleeve partially inflated and the hard cover blown away.

Referring now to FIG. 2, the torpedo recovery system includes a thin-wall sleeve 28 specifically folded and clamped to perform two significant functions. In the process of recovering an exercised torpedo, it is first necessary to slow the torpedo without damaging the recovery system and once the torpedo is sufficiently slowed, to apply sufficient buoyancy to bring it to the surface of the water. To accomplish these objectives, the torpedo, after being exercised, begins to inflate sleeve 28 as shown in FIG. 2. This inflation is induced by a gas generating system not forming a part of this invention. Typically, gas generation systems in a torpedo will include a relief valve actuable in response to the difference in pressure between the volume within sleeve 28 and the water surrounding it. When the appropriate pressure difference is achieved, gas generation is shut off or bled off so that inflatable sleeve 28 is not over inflated and destroyed. Also, as the torpedo is lifted in the water towards its surface any gas within sleeve 28 will expand and a relief valve will bleed off excess gas to prevent bag damage.

It is, of course, important that gas be generated at such a temperature that it will not burn or otherwise damage the sleeve 28. In order to control the temperature of gas within sleeve 28, gas can either be generated in the range of less than about 400° F., or if generated at a higher temperature, can be passed through longitudinal holes in the shell of the torpedo for cooling. This figure illustrates a level of sleeve inflation just great enough to blow the hard cover. As sleeve 28 inflates, it assumes a rather streamline shape while providing sufficient drag to decelerate the torpedo as will be discussed in greater detail with respect to FIG. 4.

Figure 3:
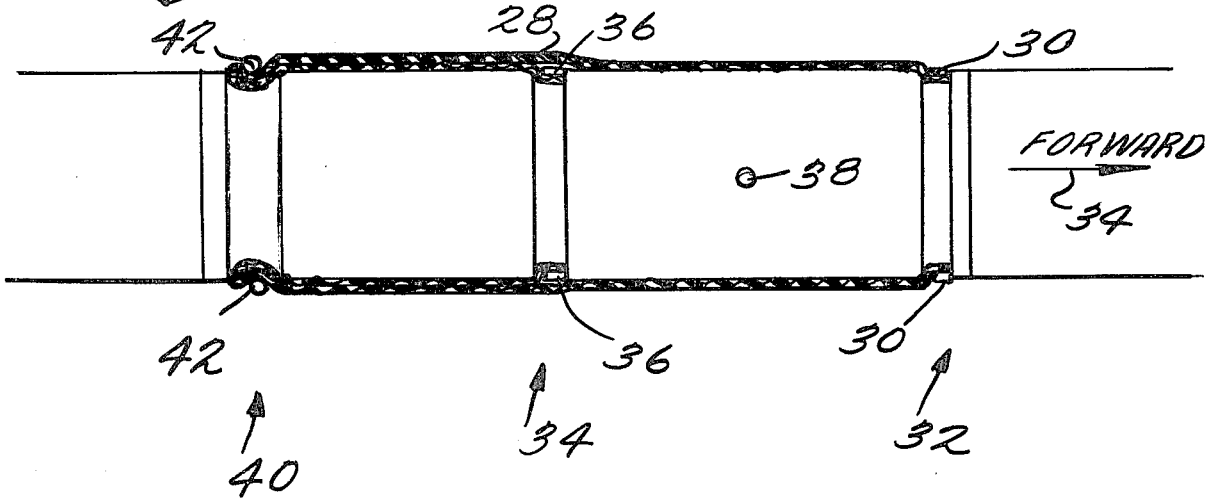
FIG. 3 is a cutaway side view of the torpedo recovery system showing the sleeve in its uninflated position.

Referring now to FIG. 3, there is shown a cutaway side view of the torpedo recovery system according to the present invention. The exercise section of the torpedo is generally separable from the remainder of the torpedo, and can be handled as a unit. Sleeve 28 is fabricated from rubber approximately ⅛" thick. This is considered a "thin wall" and is instrumental in achieving many of the advantages and features of the present invention. When unfolded and fully elongated, sleeve 28 is in the form of a cylinder having sufficient diameter to surround the torpedo. Sleeve 28 is slipped over the aft end of the exercise section of the torpedo and is circumferentially clamped by a clamping member 36 at longitudinal position 34 along the torpedo. In FIG. 3, the forward end of torpedo 20 and its direction of travel in the water are indicated by arrow 34. The remaining end of sleeve 28 is pulled forward over clamp 36 and is clamped at a longitudinal position 32 along the torpedo's length by a second clamping member 30. Clamping members 30 and 36 secure sleeve 28 to the outer surface of torpedo 20 about its entire circumference. These clamping members form a gas-tight seal at first longitudinal position 32 and longitudinal position 34 between the outer surface of torpedo 20 and sleeve 28. Sleeve 28 is not a closed bag as with some prior art devices. It cannot function apart from torpedo 20 or other object being recovered. Sleeve 28 is a "sheet" forming one boundary for the inflating gas and the outer surface of torpedo 20 itself forms the remaining boundary.

Inflation of sleeve 28 is initiated by the flow of gas through a gas port 38 bored in the outer surface of the torpedo 20 and coupled to a suitable internal gas generator as discussed above.

Sleeve 28 in its unstretched state is designed to be longer than the distance between first longitudinal position 32 and second longitudinal position 34 so that a portion of the sleeve can be folded over itself and clamped at yet a third longitudinal position 40, the most rearward of the three clamping positions as is shown in FIG. 3. Sleeve 28 is pulled back relatively tautly, but not stretched so as to deform, so as to form two layers of material between second longitudinal position 34 and third longitudinal position 40. Both layers are clamped at position 40 by a clamping member 42. Clamping member 42 is chosen such that when sleeve 28 is inflated to a predetermined volume, this clamping member will free the sleeve. Sleeve 28 remains permanently clamped at positions 32 and 34 during inflation. Clamping member 42 can be fabricated from rubber, spring material, or can be of other suitable releasable configuration.

Figure 4:
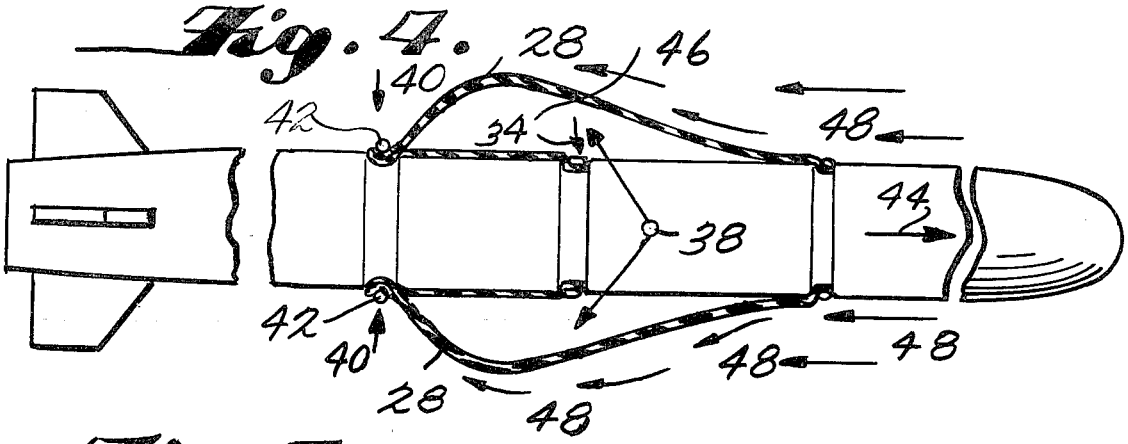
FIG. 4 is a cutaway view of the torpedo recovery system showing the sleeve partially inflated and assuming a streamlined shape by virtue of the forward motion of the torpedo, and the relatively thin wall of the bag.

Referring now to FIG. 4, there is shown a cutaway side view of the torpedo recovery system showing sleeve 28 in its initial stage of inflation. Releasable clamping member 42 is still holding both layers securely to the outer surface of torpedo 20 at longitudinal position 40. A gas emitted into a region 46 defined by the outer surface of torpedo 20 and the inner surface of sleeve 28 has, in this view, forced sleeve 28 outwardly, thereby expanding it from its initial position against the surface of the torpedo 20. By virtue of the forward motion of the torpedo, as indicated by arrow 44, and the buildup of pressure within region 46, sleeve 28 begins to assume a somewhat streamline shape. The flow of water around the torpedo and sleeve while the torpedo is in forward motion is indicated by the streamline arrows 48. As sleeve 28 expands, it begins to apply significant drag to torpedo 20, thereby causing it to decelerate. Note that even as torpedo 20 begins to decelerate, third clamping member 42 still holds sleeve 28 securely at longitudinal position 40. As further gas flow causes sleeve 28 to expand further, clamping member 42 will eventually release and sleeve 28 will assume a shape as shown in FIG. 5.

Figure 5:
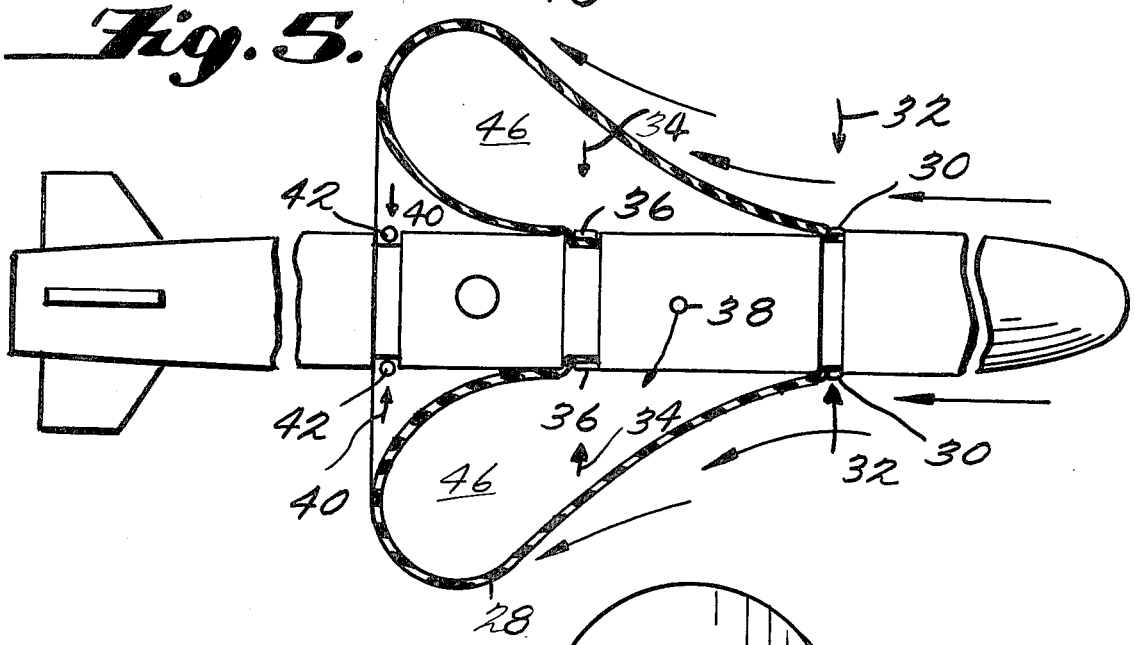
FIG. 5 is a cutaway view of the torpedo recovery system according to the present invention, wherein the sleeve is further inflated than as shown in FIG. 4 and wherein the third means for clamping has released the folded portion of the sleeve.

Referring now to FIG. 5, there is shown another cutaway side view of the torpedo recovery system according to the present invention. In this figure, sleeve 28 is shown further inflated than as shown in FIG. 4. Gas continues to be emitted through port 38 into region 46 and thus sleeve 28 continues to expand. As shown in FIG. 5, sleeve 28 has expanded to a point beyond the predetermined clamping strength of clamping member 42 at longitudinal position 40 and the sleeve has broken free from this most rearward clamped position. As sleeve 28 continues to expand, the level of drag induced for a fixed torpedo velocity increases. Of course, the torpedo is continuing to decelerate and does so in a smooth predetermined manner by virtue of the gradual expansion of sleeve 28 around it. By virtue of the gradual unfolding of the two layers of rubber constituting sleeve 28 in the region between positions 34 and 40, the drag induced by the sleeve is gradually increased while undue stress on the sleeve is avoided. As the expansion increases, there also is an increasing amount of material available, so that sleeve 28 is not stretched to destruction. Clamping members 30 and 36 continue to hold sleeve 28 in a gas-tight seal at longitudinal positions 32 and 34.

Figure 6:
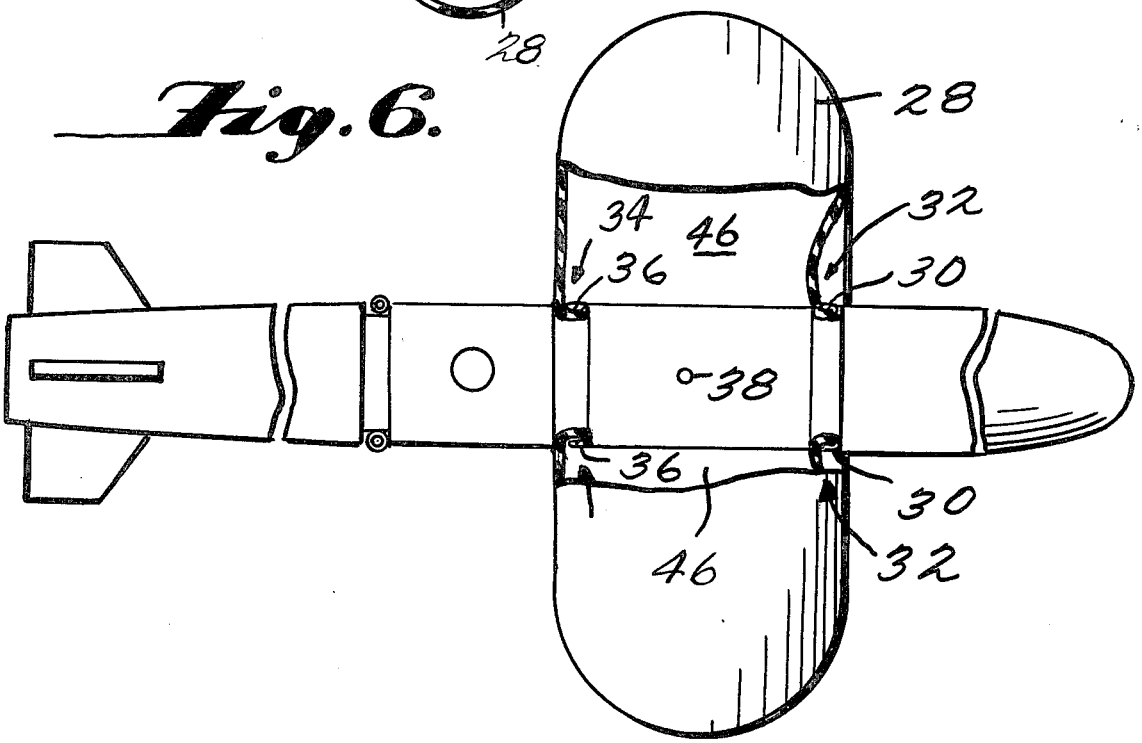
FIG. 6 is a partially cutaway side view of the torpedo recovery system wherein the sleeve is fully inflated.

Referring now to FIG. 6, there is shown a partially cutaway side view of the torpedo recovery system according to the present invention. In this view, sleeve 28 is shown fully inflated and clamped securely by clamping member 30 at longitudinal position 32 and by clamping member 36 at longitudinal position 34. Fully inflated, sleeve 28 assumes the general form of a tire surrounding torpedo 20. Once having assumed this shape, no further gas is induced into region 46 via port 38. At some point during inflation of sleeve 28, sufficient buoyancy will be imparted to torpedo 20 so that its nose end will turn toward the surface of the water and begin to rise. In most cases, by the time sleeve 28 has inflated to the degree indicated in FIG. 6, the nose of torpedo 20 will have already turned toward the water's surface. As this process occurs, sleeve 28 will begin to deform in shape due to the weight of torpedo 20 acting against the positive buoyancy force. This deformation is illustrated in FIG. 7.

Figure 7:
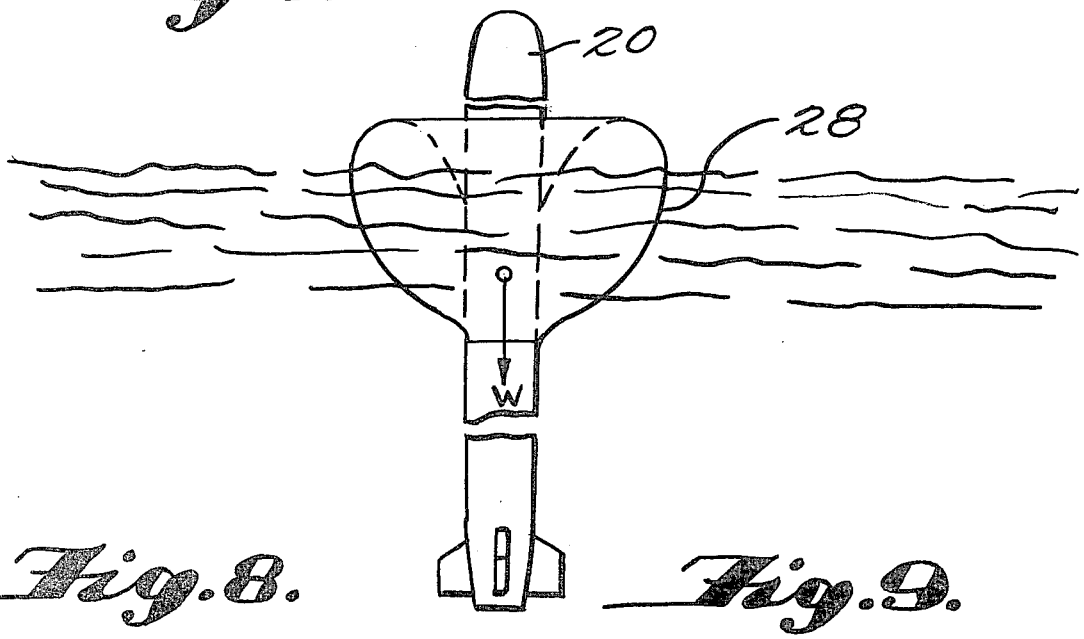
FIG. 7 is a side view of the torpedo recovery system showing its distended shape from the weight of a torpedo being held buoyant at the surface of the water.

Referring now to FIG. 7, there is shown a side view of the torpedo and torpedo recovery system. In this view, sleeve 28 has applied sufficient positive buoyancy to torpedo 20 to bring it to the water's surface. Arrow W indicates the weight vector of torpedo 20 causing sleeve 28 to assume a distended shape as shown in the figure.

Figure 8:
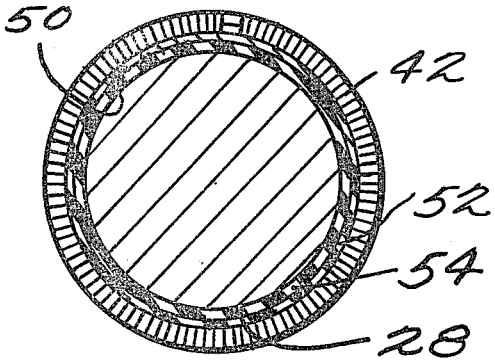
FIG. 8 is a sectional view of the torpedo recovery system according to the present invention taken along line 8—8 of FIG. 3.

Referring now to FIG. 8, there is shown a sectional view of the torpedo recovery system according to the present invention taken along line 8—8 of FIG. 3. This figure more clearly shows clamping member 42 holding sleeve 28 to the outer surface 50 of this torpedo. At longitudinal position 40, sleeve 28 includes an outer layer 52 and an inner layer 54 while being held in position by clamping member 42.

Figure 9:
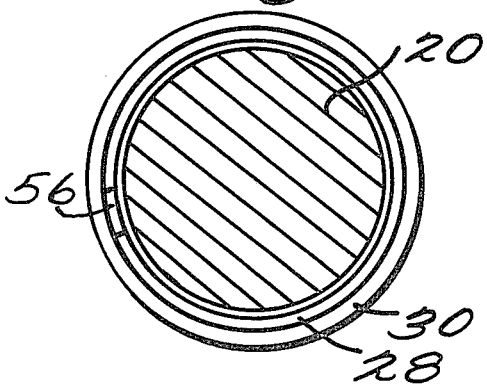
FIG. 9 is a cross-sectional view of the torpedo recovery system taken along line 9—9 of FIG. 3.

Referring now to FIG. 9, there is shown a cross-sectional view of the torpedo recovery system taken along line 9—9 of FIG. 3, corresponding to first longitudinal position 32. Clamping member 30 is shown surrounding a single layer of sleeve 28 snugly fit against the outer surface of torpedo 20. A locking member 56 is shown holding clamping member 30 securely in place.

Figure 10:
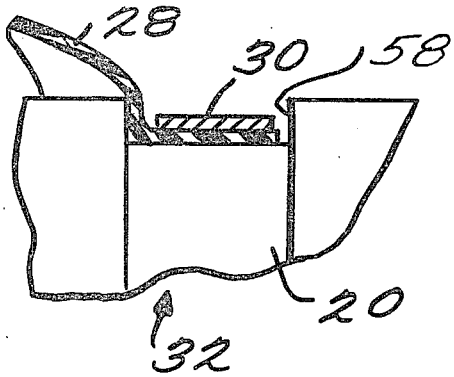
FIG. 10 is an enlarged cutaway view of the first means for clamping shown generally in FIG. 3.

Referring now to FIG. 10, there is shown an enlarged cutaway view of the first clamping member 30 shown generally in FIG. 3. Clamping member 30 is holding sleeve 28 securely against the outer surface of torpedo 20. To facilitate clamping, a groove 58 can be cut in the outer surface of torpedo 20 and sleeve 28 is clamped securely within the groove. Adhesive or other suitable sealant applied over groove 58 before sleeve 28 is attached can facilitate a good gas-tight seal. Groove 58 prevents clamp 30 and sleeve 28 from sliding out of position.

Figure 11:
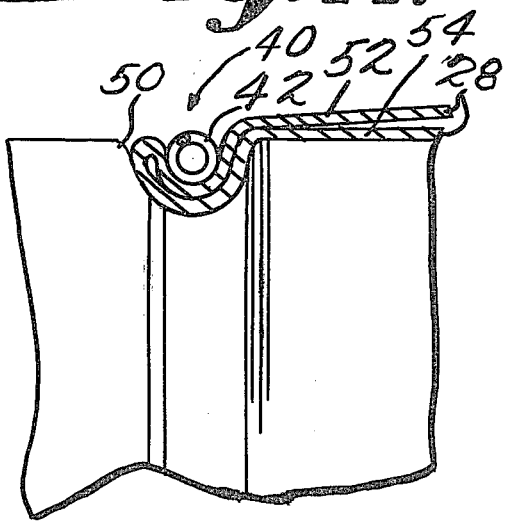
FIG. 11 is an enlarged view of the third means for clamping shown generally in FIG. 3.

Referring now to FIG. 11, there is shown an enlarged view of the third clamping member 42 shown generally in FIG. 3. At longitudinal position 40 as indicated by the arrow, clamping member 42 securely fastens both layers of sleeve 28 (inner layer 54 and outer layer 52) against the outer surface of torpedo 20. As at first longitudinal position 32, a groove 60 is cut in the outer surface of the torpedo and clamping member 42 holds sleeve 28 securely within the groove.

In essence, there has been provided a recovery system for torpedoes and other underwater projectiles including a thin-walled generally cylindrically shaped sleeve having first and second ends surrounding at least a portion of a torpedo to be recovered after being exercised. The recovery system includes first means for clamping the first end of the sleeve circumferentially about the torpedo at a first longitudinal position along the torpedo so as to form a gas-tight seal between the sleeve and the torpedo at this first longitudinal position. The system further includes second means for clamping the second end of the sleeve circumferentially about the torpedo at a second longitudinal position so as to form a gas-tight seal between the sleeve and the torpedo at this second longitudinal position. The sleeve has a length greater than the distance between the first and second longitudinal positions such that it can be layered over itself when being secured at the first and second longitudinal positions. The system further includes a third means for clamping a layered portion of the sleeve at a third longitudinal position along the torpedo, this third longitudinal position being further removed from the first longitudinal position than the second longitudinal position is from the first longitudinal position and along the same direction along which the second longitudinal position is located with respect to the first longitudinal position. In order to inflate the sleeve, means are provided for injecting gas into the region bounded by the sleeve and the torpedo to inflate the sleeve.

The recovery system according to the present invention features a thin-walled sleeve as opposed to the heavy-walled bags utilized in prior art systems. The use of a thin-walled bag allows the material to be rolled back giving access to the shell of the torpedo for installation of marker devices and other equipment.

When upright in the water, a torpedo being held at the water's surface by the disclosed recovery system, has a greater portion of its surface exposed to the water.

The use of a thin-walled design allows for ease of manufacture. There is no need to construct a heavily reinforced material similar to a tire. The recovery system according to the present invention is not only easily manufactured but also is easily installed. There is no need for heavy tools to manipulate a reinforced thick-walled bag. In addition, a thin-walled sleeve is less costly to produce.

The use of a thin-walled sleeve having a portion thereof folded over itself provides for a gradual deceleration of a torpedo to which it is attached. As the bag gradually expands, the shape of the sleeve conforms to the water flow and additional material is payed out as the sleeve expands. This helps to distribute stress over an increasing amount of material so that excessive distortion will not take place at any given point.

The use of the present recovery system permits reduced volume intrusion by the recovery system into the exercise section of a torpedo. The system according to the present invention will take up considerably less space around the periphery of the torpedo than prior systems.

As a further advantage, the use of a thin-walled sleeve allows a diver to cut it with a knife while still in the water if emergency access is required.

Furthermore, the use of the present design including a gradually unfolding sleeve, permits the flexibility to design a system wherein the drag applied can be precisely controlled.

What is claimed and desired to be secured by Letters Patent of the United States is:

1. A recovery system for underwater projectiles comprising:

a generally cylindrically shaped sleeve having first and second ends for surrounding at least a portion of said projectile;

first means for clamping said first end of said sleeve circumferentially about said projectile at a first longitudinal position along said projectile so as to form a gas-tight seal between said sleeve and said projectile at said first longitudinal position;

second means for clamping said second end of said sleeve circumferentially about said projectile at a second longitudinal position along said projectile so as to form a gas-tight seal between said sleeve and said projectile at said second longitudinal position, said sleeve having a length greater than the distance between said first and second longitudinal positions such that it can be layered over itself when being secured at said first and second longitudinal positions;

third means for clamping a layered portion of said sleeve at a third longitudinal position along said projectile, said third longitudinal position further removed from said first longitudinal position than said second longitudinal position is from said first longitudinal position and along the same direction along which said second longitudinal position is located with respect to said first longitudinal position; and means for injecting gas into the region bounded by said sleeve and said projectile for inflating said sleeve.

2. A recovery system according to claim 1 wherein said third means for clamping releases said layered portion of said sleeve from said projectile when the pressure differential between the volume contained by said sleeve and the water exceeds a predetermined threshold level.

3. A recovery system according to claims 1 or 2 wherein said first and second means for clamping each comprise:

a circumferential groove about the outer surface of said projectile;

a generally circularly shaped clamping member for holding said sleeve within said circumferential groove.

4. A recovery system according to claim 3 further including an adhesive within said groove between said projectile and said sleeve.

5. A recovery system according to claim 3 further including a sealant within said groove between said projectile and said sleeve.

6. A recovery system according to claim 1 further including removable means for covering said sleeve when it is not inflated.

7. A recovery system according to claim 1 wherein said sleeve is fabricated from rubber that is less than $\frac{1}{4}''$ thick.

8. A recovery system according to claim 7 wherein said sleeve is fabricated from rubber and is substantially $\frac{1}{8}''$ thick.

* * * * *